US006119489A

United States Patent [19]

Roschen et al.

[11] Patent Number: 6,119,489

[45] Date of Patent: Sep. 19, 2000

[54] KNITTING MACHINE PARTS RESISTANT TO ABRASION BY YARN OF CUT-RESISTANT FIBER

[75] Inventors: Robert E. Roschen, Wall Township; Herman Leslie Lanieve, Warren, both of N.J.; Scott W. Thompson, Charlotte, N.C.

[73] Assignee: HNA Holdings, Inc., Warren, N.J.

[21] Appl. No.: 09/144,246

[22] Filed: Aug. 31, 1998

[51] Int. Cl.[7] ..... D04B 35/02

[52] U.S. Cl. ..... 66/116; 66/123; 66/104

[58] Field of Search ..... 66/104, 116, 121, 66/122, 123

[56] References Cited

U.S. PATENT DOCUMENTS

| | | | |
|---|---|---|---|
| 5,077,990 | 1/1992 | Plath | 66/123 |
| 5,538,799 | 7/1996 | Nanya et al. | 428/626 |
| 5,546,770 | 8/1996 | Nanya | 66/116 |
| 5,642,632 | 7/1997 | Nanya et al. | 66/104 |
| 5,948,548 | 9/1999 | Welty et al. | 428/623 |

FOREIGN PATENT DOCUMENTS

| | | |
|---|---|---|
| 847518 | 2/1977 | Belgium . |
| 62-28452 | 2/1987 | Japan . |
| 62-28453 | 2/1987 | Japan . |
| 62-41358 | 2/1987 | Japan . |
| 4-66659 | 3/1992 | Japan . |

*Primary Examiner*—John J. Calvert
*Assistant Examiner*—Robert H. Muromoto, Jr.
*Attorney, Agent, or Firm*—Alston & Bird LLP

[57] ABSTRACT

A knitting machine part which is resistant to abrasion caused by knitting a yarn of cut-resistant fiber contains: (i) a base substrate having at least one yarn-contacting region for contacting the yarn during the knitting process, and (ii) a coating disposed on the surface of the base substrate on at least the yarn-contacting region of the base substrate, wherein the coating contains titanium carbonitride having a carbon-to-nitrogen weight ratio of from about 1:4 to 4:1, preferably from about 1:1.5 to 1.5:1, most preferably about 1:1. The knitting machine part is preferably a knitting needle or a sinker. The cut-resistant yarn is preferably composed of at least one cut-resistant fiber formed from a fiber-forming polymer and a hard filler having a Mohs Hardness value of at least about 3, the hard filler being distributed in the fiber-forming polymer. The coated knitting machine part may also be used to knit conventional fibers and yarns, for example, fibers and yarns which are not cut-resistant, including abrasive fibers which are not cut-resistant.

41 Claims, 1 Drawing Sheet

KNITTING MACHINE PARTS RESISTANT TO ABRASION BY YARN OF CUT-RESISTANT FIBER

BACKGROUND OF THE INVENTION

This invention relates to knitting machine parts. More particularly, this invention relates to knitting machine parts which have improved resistance to abrasion caused by knitting yarns of cut-resistant fiber.

Knitting needles used in automatic knitting machines constantly rub against the base of the needle bed during operation of the knitting machine, causing friction and a high occurrence of broken needles. To overcome this problem, knitting needles have been made with materials such as SK material (carbon tool steel), SKS material (alloy tool steel) and the like, which have been heat-treated to increase the abrasion resistance thereof.

However, a new problem has arisen in recent years due to the use of synthetic fibers in knitting yarns. Such fibers tend to increase the friction between the knitting needle and the yarn during the knitting process, resulting in abrasion to the knitting needle at the areas in which the needle comes into contact with the yarn.

To eliminate this problem, knitting needles have been made from sintered hard alloys having high abrasion resistance. However, the bend resistance of sintered hard alloys tends to decrease when the abrasion resistance thereof is increased.

Other efforts to improve the abrasion resistance of knitting needles have involved providing the knitting needle with an abrasion resistant coating. Knitting needles with such coatings are disclosed, for example, in Japanese Kokai Patent Application No. Sho 62[1987]-28452; Japanese Kokai Patent Application No. Sho 62[1987]-28453; Japanese Kokai Patent Application No. Sho 62[1987]-41358; Japanese Kokai Patent Application No. Hei 4[1992]-66659. In Japanese Kokai Patent Application No. Sho 62[1987]-28452 ("JP-28452"), a knitting needle is coated with a metal carbide, such as, e.g., titanium carbide. The titanium carbide coating may contain 7% by weight or less of oxygen, nitrogen, etc. The metal carbide coating can be made by a plasma chemical vapor deposition (CVD) process. JP-28452 teaches that, to form a titanium carbide coating, the base material temperature used during the plasma CVD process ranges from 400° C. to 600° C. JP-28452 further teaches that the metal carbide coating provides the knitting needle therein with high abrasion resistance in those portions of the needle which come into contact with the needle bed, the knitting yarn, and the drive unit.

Japanese Kokai Patent Application No. Sho 62[1987]-28453 ("JP-28453") teaches a knitting needle coated with a metal nitride, such as, e.g., titanium nitride. The titanium nitride coating may contain about 1% by weight or less of oxygen, carbon, and the like. The metal nitride coating may be made by reactive sputtering or by ion plating. During the reactive sputtering process, the base material temperature ranges from about 200° C. to 300° C. During the ion plating process, the base material temperature ranges from about 20° C. to about 350° C. In the example set forth in this reference, titanium nitride (sample A) is formed using a base material temperature of 300° C. JP-28453 further teaches that the metal nitride coating provides the knitting needle therein with high abrasion resistance in those portions of the needle which slide on needle beds, contact the knitting yarn, and contact the drive unit.

In Japanese Kokai Patent Application No. Sho 62[1987]-41358 ("JP-41358"), a knitting needle is coated with a metal oxide material, e.g., titanium oxide. The metal oxide coating may be made by reactive sputtering or by ion plating. During the reactive sputtering process, the base material temperature ranges from about 200° C. to 300° C. During the ion plating process, the base material temperature ranges from about 20° C. to about 350° C. JP-41358 teaches that the metal oxide coating therein improves the abrasion resistance of those portions of the knitting needle that slide on needle beds, contact the knitting yarn and contact the drive unit.

In Japanese Kokai Patent Application No. Hei 4[1992]-66659 ("JP-66659"), objects such as cutter edges, sewing machine needles, and circular blades, are provided with a titanium nitride coating composed mainly of $Ti_2N$ formed by a physical vapor deposition process. In distinguishing between $Ti_2N$ and TiN, this reference states that the formation of TiN coatings by a CVD process requires high temperatures (800° C. and higher), whereas $Ti_2N$ coatings can be formed by a CVD process at temperatures ranging from as low as room temperature to 600° C. JP-66659 does not disclose what items (e.g., needle beds, knitting yarn, etc.) the coated objects disclosed therein are resistant to.

Although the aforementioned JP-28452, JP-28453 and JP-41358 references each disclose that the coated knitting needles therein are resistant to, among other things, knitting yarns, none of these references teach whether the yarns are cut-resistant. The present invention is based in part on the discovery that yarns of cut-resistant fiber, particularly cut-resistant fiber that contains a hard particulate filler, are more abrasive to knitting machine parts than are conventional non-cut-resistant-fiber yarns. Thus, a particular coating on a knitting machine part which improves the part's resistance to abrasion caused by knitting conventional yarns may not provide the part with abrasion-resistance against yarns of cut-resistant fiber. For example, it has been found that titanium nitride coatings are not hard enough to resist CRF® yarn, where CRF yarn is comprised of polyester filaments that contain hard particles, such as alumina. (CRF is a registered trademark of HNA Holdings, Inc.). Thus, it is desirable to provide a coating for a knitting machine part which provides the knitting machine part with improved resistance to a yarn comprised of particle-filled cut-resistant fiber.

Chemical vapor deposition (CVD) has been used to form coatings on knitting machine parts. For example, the use of such a process is taught in JP-28452, which was mentioned hereinabove. In forming a coating layer on a knitting machine part by a CVD process, it is desirable that the processing temperature not be excessively high, e.g., greater than 1000° C. Processing temperatures which are too high can cause excessive warping of the knitting machine part as well as compromise the shaping workability, hardness and breaking resistance of the part. For example, it has been found that although titanium carbide coatings and certain titanium carbonitride coatings containing low levels of nitrogen relative to carbon provide abrasion resistance to knitting machine parts, the high CVD temperatures involved in forming such coatings damage the parts. However, while excessively high CVD process temperatures are undesirable, it is at the same time desirable that the temperature of the CVD process be high enough to allow the coating to be strongly adhered to the part. Thus, it would be desirable to provide a coating for a knitting machine part which improves the resistance of the part to abrasion caused by knitting CRF yarn and which can be formed on the part by means of a CVD process which uses a deposition temperature that is too low to cause warpage of the part but high enough to provide a strong adherence between the coating and the knitting machine part.

Accordingly, a primary object of this invention is to provide a knitting machine part having improved resistance to abrasion caused by knitting a yarn comprising a particle-filled cut-resistant fiber.

A further object of this invention is to provide a knitting machine part having improved resistance to abrasion that is caused by knitting a yarn comprised of cut-resistant fiber, wherein such abrasion-resistance is provided to the part by a coating which can be formed on such part by a chemical vapor deposition process at a temperature which is low enough to avoid warping of the part but high enough to provide strong adherence between the coating and the part.

These and other objects which are achieved according to the present invention can be discerned from the following description.

SUMMARY OF THE INVENTION

The present invention is based on the discovery that the abrasion-resistance of a knitting machine part against a yarn made of cut-resistant fiber can be substantially improved by coating the part with a particular type of titanium carbonitride material.

Accordingly, one aspect of the present invention is directed to a knitting machine part which has improved resistance to abrasion caused by knitting a yarn made of particle-filled cut-resistant fiber. The knitting machine part of this invention contains:

(i) a base substrate having at least one yarn-contacting region for contacting the yarn during the knitting process; and (ii) a coating disposed on the surface of the base substrate on at least the yarn-contacting region of the base substrate, wherein the coating contains titanium carbonitride having a carbon-to-nitrogen weight ratio of from about 1:4 to about 4:1, preferably from about 1:1.5 to about 1.5:1, and most preferably about 1:1. The ideal ratio is an atomic ratio of 1:1, which corresponds to a weight ratio of 1:1.07.

The knitting machine part of this invention is preferably a knitting needle or a sinker.

More generally, this invention is directed to a part or parts of machines that are used to handle yarns, particularly abrasive yarns, such as yarns comprising particle-filled cut-resistant fibers. The machine part contains: (i) a base substrate having a surface and having at least one yarn-contacting region for contacting the yarn when the yarn is being handled, processed, or manufactured by the machine, and (ii) a coating disposed on the surface of at least the yarn-contacting region of the base substrate, wherein the coating contains titanium carbonitride as described above. Examples of machines that may be used to handle, process, or manufacture yarns that may be abrasive include knitting machines; weaving looms; yarn twisting, repackaging, and wrapping machines; and beaming equipment. Examples of parts that may be beneficially coated in each of these kinds of machines follow:

Knitting machines: needles, sinkers, sinker plates, guides, cutters.

Weaving looms: guides, pins, tension disks, tension poles, drop wires, drop wire holding rods, scissors, heddles, reeds and fill insertion equipment, including shuttle and rapier head parts.

Yarn twisting, repackaging and wrapping machines: guides, tensioning equipment and rings.

Beaming equipment: guides and tension bars.

A further aspect of this invention is directed to a method of knitting a yarn of a fiber that may be abrasive such as a particle-filled cut-resistant fiber, involving the steps of:

(1) providing the yarn;

(2) providing a knitting machine which includes the knitting machine part described above; and (3) subjecting the yarn to a knitting process using the knitting machine such that at least the yarn-contacting region of the knitting machine part contacts the yarn during the knitting process.

More broadly, this invention is a method of handling, processing, or manufacturing a yarn which may comprise an abrasive fiber, comprising the steps of: (I) providing or spinning the yarn; (ii) providing a machine which includes one or more of the coated parts described above; and (iii) processing the yarn such that at least the yarn-contacting region of the part or parts contacts the yarn as it is being processed or spun. The process is particularly suited to the handling, processing, or, manufacturing of yarns that include an abrasive filler, but is also suitable for conventional fibers and yarns as well, whether or not they are abrasive. By following this process, wear on the machine is substantially decreased for all kinds of fibers.

Preferably, the yarn of cut-resistant fiber is composed of at least one cut-resistant fiber formed from a fiber-forming polymer and a hard filler having a Mohs Hardness value of at least about 3.0, wherein the hard filler is distributed in the fiber-forming polymer.

The coated knitting needle or other machine parts of this invention may also be used to knit or handle yarns of non-cut-resistant fiber, such as abrasive, non-cut-resistant fibers and yarns, and also conventional non-abrasive yarns. In general, the coated machine parts described herein may be used to process or handle any yarn with reduced wear on the machine.

A primary advantage of the present invention is that the coated yarn-contacting region(s) of the knitting machine part or other machine part has excellent resistance to abrasion caused by knitting yarns of particle-filled cut-resistant fiber and other abrasive fibers.

A further advantage of the present invention is that the particular titanium carbonitride coating used herein is capable of being formed on the knitting machine part by means of a chemical vapor deposition process which uses a deposition temperature as low as about 800° C. Such deposition temperature is high enough to provide strong adherence of the coating to the part but low enough to avoid warpage of the part.

DETAILED DESCRIPTION OF THE INVENTION

Figure 1:
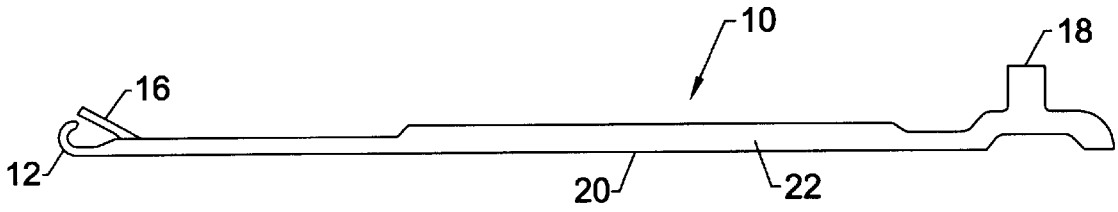
FIG. 1 is a schematic side view of a knitting needle which can be coated in accordance with the present invention.

The present invention provides a coated knitting machine part which has excellent resistance to abrasion caused by knitting a yarn of cut-resistant fiber, particularly a hard particle-filled cut-resistant fiber. The knitting machine part of this invention is preferably either a knitting needle or a sinker.

The knitting machine part of this invention contains a base substrate, which has a surface and a coating on at least a portion of the surface of the base substrate. The base substrate has at least one yarn-contacting region on the surface for contacting the yarn during the knitting process.

The coating is disposed on at least the yarn-contacting region(s) of the surface of the base substrate.

As used herein, the term "yarn-contacting region" refers to that portion of the base substrate which will come into contact with the yarn during the knitting process. In a knitting needle, the yarn-contacting region typically includes at least the hook area of the needle.

The coating used in the present invention is a titanium carbonitride material having a carbon-to-nitrogen weight ratio of from about 1:4 to about 4:1, preferably from about 1:1.5 to about 1.5:1, and most preferably about 1:1. Such a titanium carbonitride coating provides the coated portions of the base substrate of the knitting machine part with excellent resistance to abrasion caused by knitting yarns of cut-resistant fiber. For example, when used to knit gloves from yarns of cut-resistant fiber, conventional uncoated 13-gauge steel sinkers are generally effective for knitting up to about 500 gloves. On the other hand, such sinkers when coated with the titanium carbonitride coating used in the present invention will last about 10 times longer, i.e., will be effective for knitting up to about 5000 gloves.

The titanium carbonitride coating may be disposed on only the yarn-contacting region(s) of the knitting machine part or, alternatively, on the entire base substrate, i.e., the coating may be uniformly disposed on the base substrate.

The titanium carbonitride coating used in the present invention provides the surface coated therewith with sufficient hardness to withstand the abrasion caused by knitting of cut-resistant fibers.

To produce the titanium carbonitride coating on the knitting machine part, a chemical vapor deposition (CVD) process can be used quite effectively. As mentioned previously herein, an advantage provided by the present invention is that the titanium carbonitride coating used herein is capable of being formed on the base substrate by a CVD process which uses a deposition temperature as low as about 800° C. Preferably, the coating is formed on the base substrate by a CVD process carried out at a temperature of from about 800° C. to about 1000° C., more preferably about 800° C.

For example, the coating may be formed by a CVD process which involves heating the machine part to 800° C. at low pressure, then exposing the part to chemical vapor for a period of time sufficient to provide a coating of desired thickness. In the present invention, the preferred thickness of the titanium carbonitride coating on the base substrate of the knitting machine part is preferably at least about 2.0 microns and more preferably from about 2.0 to about 15.0 microns.

The raw material used in the CVD process can be composed of many components as needed. Materials suitable for use as a carrier in the CVD process include, e.g., hydrogen, argon, helium, with hydrogen being preferred. The CVD process may be carried out at an operating pressure of from about 0.1 to about 1.5 torr and a base material temperature of from about 800° C. to about 1000° C. The base substrate of the knitting machine part of this invention can be composed of any material which has adequate processability, hardness and bend resistance to serve as a knitting machine part. Preferably, the base substrate is composed of an iron series metal or a hard sintered alloy. More preferably, the base substrate is composed of carbon steel or stainless steel.

When the base substrate is composed of a carbon steel or a stainless steel (e.g., a type AISI 1086H high carbon steel), the high temperatures used to coat the base substrate with the titanium carbonitride material may cause the steel substrate to soften, resulting in reduced toughness and resistance to bending and breaking during knitting. Consequently, when a carbon steel or stainless steel base substrate is used, the substrate should be subjected to a steel-annealing heat treatment process after the coating deposition process in order to provide the coated substrate with sufficient hardness and toughness to withstand the forces associated with knitting. Any conventional steel-annealing heat treatment process can be used so long as such a process does not affect the hardness of the coating on the surface. Preferably, the coated substrate is subjected to a steel-annealing heat treatment process involving the steps of:

(i) heating the coated substrate (e.g., in a furnace) to a temperature sufficient to austentize said substrate, such temperature preferably being at least about 750° C., more preferably from about 800° C. to about 875° C., most preferably about 850° C., the austentizing step preferably being conducted in an inert atmosphere;

(ii) quenching the austentized coated substrate, such quenching preferably being carried out in an inert atmosphere in a 20-bar furnace or in oil with agitation at a quenching temperature ranging from about 60° C. to about 200° C. and at a quenching rate such that upon tempering and cooling of the austentized substrate, the tempered-cooled substrate has a hardness sufficient to withstand the forces associated with knitting;

(iii) heating the quenched coated substrate to a temperature and for a period of time sufficient to temper the substrate, such temperature preferably ranging from about 250° C. to about 350° C. and such time period preferably being about 1 hour; and (iv) cooling (e.g., air cooling) the tempered coated substrate, whereby the cooled substrate has a hardness and toughness sufficient to withstand the forces associated with knitting. The coated surface retains the hardness needed to resist abrasion associated with knitting.

In step (ii) of the steel-annealing process set forth above, the austentized coated substrate may undergo quenching in oil with agitation or, in more preferred embodiments of the invention, in an inert atmosphere in a 20-bar furnace. If oil is used as the quenching medium, the quenching temperature is preferably from about 60° C. to about 200° C., more preferably from about 60° C. to about 120° C., because an oil-quenching temperature within such range will provide the coated substrate with additional toughness. If the quenching medium is an inert atmosphere, quenching is preferably carried out in a 20-bar furnace. It has been found that a 10-bar furnace does not always provide a sufficient cooling rate to obtain the necessary hardness.

In the quenching step of the steel-annealing process described above, the quenching is carried out at a rate such that the tempered and cooled substrate is provided with a hardness sufficient to withstand the forces associated with knitting, e.g., a Rockwell-C Hardness value of from about 50 to about 55. Quenching rates or the "severity of quenching" has been defined by the Society of Automotive Engineers (SAE) in terms of an "H value". For low severity (i.e., low quenching rates), the H value is from 0.2 to 0.45. For intermediate severity (i.e., intermediate quenching rates), the H value is from 0.45 to 1. For high severity (i.e., high quenching rates), the H value is from 1 to 4. With oil quenching, the H value is controlled by the rate of agitation measured in meters per minute as shown below:

| Agitation | Rate(meters/min) | H value for oil |
|---|---|---|
| None | 0 | 0.2 |
| Mild | 15 | 0.3 |
| Moderate | 30 | 0.4 |
| Good | 61 | 0.5 |
| Strong | 230 | 0.6–0.8 |

To obtain a Rockwell-C Hardness value of 55 in the tempered carbon steel, the steel generally must be quenched to a Rockwell-C Hardness value of from about 60 to about 65. Small parts like the knitting machine parts used in the present invention are easier than thicker parts to quench to the 60 Rockwell-C Hardness value. The quench severity for such small parts should be intermediate with an H value of from about 0.5 to about 0.7, and inert atmosphere should be maintained to prevent scale formation. For a AISI type 1086 steel substrate, the H value needed to achieve a Rockwell-C Hardness value of 60 should be from about 0.5 to about 0.7. For oil quenching, agitation should be strong enough to provide such an H value and the oil quenching temperature should be about 60° C. If quenching is conducted in an inert atmosphere in a 20-bar furnace, the H value should also be from about 0.5 to about 0.7.

A steel-annealing process having the parameters described above will provide a steel substrate with hardness and toughness sufficient to resist the forces associated with knitting without binding or breaking, and the coated surface retains a hardness sufficient to withstand abrasion caused by knitting yarn of cut-resistant fiber.

The high temperatures used in the steel-annealing heat treatment process described above can cause some coatings, e.g., chromium oxide, to flake. An important advantage of the present invention is that the particular titanium carbonitride coating used herein does not flake and remains intact despite the high temperatures involved in the annealing process.

The invention will now be described with reference to FIG. 1. As shown in FIG. 1, a knitting needle 10 has a base substrate comprised of steel and includes a hook 12 which is used to latch cut-resistant yarn. Knitting needle 10 also has a tongue portion 16 which is used to prevent the unlatching of the knitting yarn from hook 12. Knitting needle 10 also has a tab 18, a back sliding area 20 and a side sliding area 22. Areas 20 and 22 rub against needle beds (not shown) in the knitting machine, producing friction.

The titanium carbonitride coating used in the present invention is formed on at least hook 12, but can also be formed on tongue portion 16, tab 18, back sliding area 20, and side sliding area 22, or may completely cover the entire knitting needle 10.

The coated knitting machine parts of this invention can be used effectively in automatic knitting machines such as, e.g., latch-type automatic knitting machines. As stated previously herein, the knitting machine part of this invention is preferably either a knitting needle or a sinker.

The present invention further provides a method of knitting yarn of cut-resistant fiber, particularly a cut-resistant fiber comprising hard particles, using the coated knitting machine part of this invention. The method of this invention involves the steps of:

(1) providing the yarn of cut-resistant fiber;

(2) providing a knitting machine which includes the knitting machine part described above; and (3) subjecting the cut-resistant yarn to a knitting process using the knitting machine such that at least the yarn-contacting region of the knitting machine part contacts the yarn during the knitting process.

The coated knitting machine part is particularly useful for knitting a yarn of cut-resistant fiber when the yarn is made from a cut-resistant fiber disclosed in copending, commonly assigned U.S. patent application Ser. No. 08/752,297, filed Nov. 19, 1996, which is hereby incorporated by reference herein. Such cut-resistant fiber is formed from a fiber-forming polymer and a hard filler distributed in the fiber-forming polymer, wherein the hard filler has a Mohs Hardness value of at least about 3.0.

As used herein, the term "fiber" includes not only conventional single fibers and filaments, but also yarns made from a multiplicity of these fibers. In general, yarns are used to make apparel, fabrics and the like.

The cut-resistant fiber may include such fiber-forming polymers as, e.g., amorphous polymers, semi-crystalline polymers, and liquid crystalline polymers.

Non-limiting examples of semi-crystalline polymers which can be used to form the cut-resistant fiber include poly(alkylene terephthalates), poly(alkylene naphthalates), poly(arylene sulfides), aliphatic and aliphatic-aromatic polyamides, and polyesters comprising monomer units derived from cyclohexanedimethanol and terephthalic acid. Examples of specific semi-crystalline polymers include poly (ethylene terephthalate), poly(butylene terephthalate), poly (ethylene naphthalate), poly(phenylene sulfide), poly(1,4-cyclohexanedimethanol terephthalate) (wherein the 1,4-cyclohexanedimethanol is a mixture of cis and trans isomers), nylon 6, nylon 6,6 and nylon 6,10. Polyolefins, particularly polyethylene and polypropylene, are other semi-crystalline polymers that may be used as the fiber-forming polymer.

The fiber-forming polymer may also be a liquid crystalline polymer (LCP). LCPs give fibers with very high tensile strength and/or modulus. Non-limiting examples of suitable liquid crystalline polymers include aromatic polyesters, aliphatic-aromatic polyesters, aromatic poly(esteramides), aliphatic-aromatic poly(esteramides), aromatic poly (esterimides), aromatic poly(estercarbonates), aromatic polyamides, aliphatic-aromatic polyamides and poly (azomethines).

The fiber-forming polymer may also be a non-liquid crystal aromatic polyamide.

The fiber-forming polymer used to form the cut resistant fiber contains a hard filler that imparts cut resistance to the fiber formed therefrom. The hard filler used in the fiber-forming polymer preferably has Mohs Hardness value of at least about 3, more preferably at least about 4, and most preferably at least about 5.

The hard filler used in the fiber-forming polymer may be a metal, a metal alloy, a ceramic or a crystalline material. Iron, steel, tungsten and nickel are examples of metals and metal alloys suitable for use as the hard filler in the fiber-forming polymer. Of these, tungsten, which has a Mohs Hardness value of from about 6.5 to 7.5, is preferred. Non-limiting examples of other fillers which can be used as the hard filler in the fiber-forming polymer include metal oxides (such as aluminum oxide), metal carbides (such as tungsten carbide), metal nitrides, metal sulfides, metal silicates, metal silicides, metal sulfates, metal phosphates, and metal borides. Other examples of suitable hard fillers include silicon dioxide and silicon carbide. The preferred hard filler is aluminum oxide, particularly, calcined alumina.

In general, the particles should have an average diameter of less than about 20 microns, preferably from about 0.05 to about 10 microns, and, in specific cases, more preferably from about 1 to about 6 microns.

On a weight basis, the filler is present in the fiber-forming polymer in an amount of preferably from about 0.05% to about 20%, more preferably from about 0.1% to about 20%. On a volume basis, the amount of filler in the fiber-forming polymer is preferably in the range of from about 0.1% to about 5%, and, more preferably from about 0.5% to about 3.0%, and most preferably from about 1.0% to about 3.0%, with the proviso that the amount of filler is within the weight ranges stated above.

The cut-resistant fiber may have a denier in the range of from about 1 to about 50 dpf, more preferably from about 2 to about 20 dpf, and most preferably from about 3 to about 15 dpf. The most preferred cut-resistant fiber is described in the Experimental Section.

Although the coated knitting machine part of this invention and the method of using same have been described herein in connection with the knitting of cut resistant fibers and yarns, such as fibers and yarns that contain hard particulate fillers, it is to be understood that the coated knitting machine part of this invention may also be used to knit conventional fibers and yarns, including non-cut-resistant fibers and yarns, other abrasive fibers and yarns, and non-abrasive fibers and yarns. For example, the coated knitting machine part of this invention may be used to knit fibers and yarns made from any of the fiber-forming polymers recited previously herein in connection with the cut-resistant fibers and yarns, wherein hard particles are not distributed in the fiber-forming polymers. Particularly suitable fibers which can be knitted with the knitting machine part of this invention include, e.g., Kevlar® fibers and polyester fibers.

The coated knitting machine part of this invention has many advantages. For example, the titanium carbonitride coating used in this invention provides the knitting machine part with strong adhesion between the coating and the base substrate of the part, and with excellent surface appearance. In addition, the titanium carbonitride material used to form the coating is capable of being formed on the part by a chemical vapor deposition process using a deposition temperature as low as about 800° C. Such low deposition temperature provides strong adhesion between the coating and the substrate without causing warpage of the part.

The present invention will now be described with reference to the following non-limiting examples.

EXPERIMENTAL

In the examples below, the abrasion-resistance of various coated knitting needles and sinkers against a yarn of particle-filled cut-resistant fiber was determined. The cut-resistant yarn used in the examples was a textured multifilament yarn containing 120 filaments and having a denier of 475. The yarn was made of poly(ethylene terephthalate) containing about 6% by weight of sintered, calcined alumina particles having an average diameter of about 2 microns. The yarn carried the CRF trademark. The abrasion-resistance of the coated knitting needles in the examples was measured by running the cut-resistant yarn across the needle at an angle (preferably 90°) sufficient to cause a tension of 47.5 grams at a test speed of 250 m/min.

In the following examples, the term "cut through" with respect to the action of the test yarn on the knitting needle means that the yarn actually cut the needle in half or cut the needle so deeply that the test yarn broke due to snagging.

Invention Example 1

Invention Example 1 illustrates the effect of a titanium carbonitride coating having a carbon-to-nitrogen weight ratio of 1:1 on the ability of a knitting needle and sinker coated therewith to resist abrasion caused by contact with a yarn of a particle-filled cut-resistant fiber.

Invention Example 1 used a 13-gauge AISI 1086H steel knitting needle having a carbon content of 0.86% by weight and a Rockwell-C Hardness of about 55 and a 13-gauge AISI 1095H steel sinker having a carbon content of 0.95% by weight and a Rockwell-C Hardness of about 55. The needle and sinker were each coated with a titanium carbonitride material having a carbon-to-nitrogen atomic ratio of 1:1 (specifically, a titanium carbonitride commercially available from Sylvester & Company, Beachwood, Ohio, under the tradename "Bernex").

After the knitting needle was coated with the titanium carbonitride material, the coated needle was subjected to a conventional steel-annealing heat treatment. Specifically, the coated needle was austentized by heating in a furnace to a temperature of between about 790° C. and 845° C. and then quenched in an inert atmosphere in a 20-bar furnace at a temperature of about 60° C. The needle was then tempered by heating to a temperature between about 280° C. and 315° C. for one hour and then air cooled. Adjustment of temperatures and quench rates within these ranges produced a Rockwell-C Hardness of 50–55 with toughness sufficient for knitting.

In Invention Example 1, after being subjected to the abrasion-resistance test for 45 minutes, the titanium carbonitride-coated knitting needle and sinker each showed only slight buffing, thus indicating high abrasion-resistance against the CRF yarn.

Although the temperature used to form the titanium carbonitride coating thereon caused the steel needle to soften, the hardness of the needle was restored to a Rockwell-C Hardness of 55 by a conventional steel-annealing heat treatment. The temperature used to form the titanium carbonitride coating on the sinker did not cause any warpage of the sinker.

Comparative Example A

In Comparative Example A, a knitting needle identical to that used in Invention Example 1 was used, except that the Example A needle was left uncoated. The abrasion-resistance of the uncoated needle was measured according to the test used in Invention Example 1.

The uncoated needle of Example A was cut in half by the CRF yarn after only 6 minutes into the abrasion-resistance test. Thus, comparison of Examples 1 and A shows that a steel knitting needle coated with the titanium carbonitride material of Example 1 had substantially better abrasion-resistance against CRF yarn than did an uncoated, otherwise identical steel knitting needle.

Comparative Example B

In Comparative Example B, Comparative Example A was repeated except that the yarn used in Example B was a conventional polyester yarn, not a CRF yarn. As noted above, in Comparative Example A, the CRF yarn cut the knitting needle in half in only 6 minutes. However, in Comparative Example B, the knitting needle was still unmarked even after 20 minutes of contact with the standard polyester yarn.

Comparative Example C

Comparative Example C illustrates the abrasion-resistance against CRF yarn of a knitting needle coated with a zirconium nitride rather than a titanium carbonitride within the scope of this invention.

In Comparative Example C, Invention Example 1 was repeated except that the needle in Comparative Example C was coated with zirconium nitride instead of with the titanium carbonitride material.

The zirconium nitride-coated knitting needle of Comparative Example C was cut in half after only 7.5 minutes into the abrasion-resistance test. As mentioned hereinabove, the titanium carbonitride-coating of Invention Example 1 had only slight buffing after 45 minutes into the abrasion-resistance test.

Thus, Invention Example 1 and Comparative Example C together show that two nitrides do not necessarily provide the same level of abrasion-resistance against a CRF yarn. Specifically, Examples 1 and C show that the titanium carbonitride used in Example 1 provided the knitting needle therein with substantially better abrasion resistance against CRF yarn than did the zirconium nitride used in Comparative Example C.

Comparative Example D

In Comparative Example D, Comparative Example C was repeated except that the coating used in Example D was a titanium carbide (specifically, a titanium carbide available under the designation "Polymet") instead of a zirconium nitride. In Comparative Example D, the sinkers as well as the knitting needle were coated with the titanium carbide material.

After 90 minutes into the abrasion-resistance test, only buffing of the yarn contact surface was noted; however, damage to the needle latches and warping of the sinkers had occurred during the coating process. Thus, although the titanium carbide-coated knitting needle and sinkers in Comparative Example D showed relatively good abrasion-resistance to the CRF yarn, the high temperature required to form the titanium carbide coating on the needle and sinkers damaged the needle latches and warped the sinkers.

As mentioned above, in Invention Example 1, the temperature required to form the titanium carbonitride coating therein did not damage the needle latches or warp the sinkers.

Comparative Examples E and F

In Comparative Examples E and F, Comparative Example D was repeated except that each of the coatings used in Examples E and F was composed of chromium oxide. The particular chromium oxides used in Examples E and F are available from K-Tech under the designations "CrO Tech40" and "CrO Tech40E", respectively.

After 45 minutes into the abrasion-resistance test, the knitting needle used in Comparative Example E showed no wear. After 60 minutes into the abrasion-resistance test, the knitting needle used in Comparative Example F showed no wear. However, in both Comparative Examples E and F, the temperature used to form the chromium oxide coatings on the knitting needles caused the steel needles to soften.

As mentioned hereinabove, although the temperature used to form the titanium carbonitride coating in Invention Example 1 caused the steel needle to soften, the needle was restored to a Rockwell-C Hardness of 55 by the steel-annealing heat treatment followed in Example 1. In Comparative Examples E and F, such heat treatment of the knitting needles in an attempt to restore their hardness caused the chromium oxide coatings to flake off. In Invention Example 1, the heat treatment did not cause the titanium carbonitride coating to flake off.

Comparative Example G

In Comparative Example G, Comparative Example D was repeated except that Example G used a diamond coating. The diamond-coated needle of Example G was cut through after only 5 minutes into the abrasion-resistance test.

Comparative Example H

In Comparative Example H, Comparative Example G was repeated except that Example H used a Diamonex coating with a thickness of 3 microns. The Diamonex-coated needle of Example H was cut through after only about 9.5 minutes into the abrasion-resistance test.

Comparative Example I

In Comparative Example I, Comparative Example H was repeated except that Comparative Example I used a Diamonex coating with a thickness of 7 microns. The Diamonex-coated needle of Example I was cut through by the CRF yarn after only about 17 minutes into the abrasion-resistance test.

Comparative Example J

In Comparative Example J, Comparative Example I was repeated except that the coating used in Example J was nickel-plating. The nickel-plated needle of Example J was cut through after only about 7 minutes into the abrasion-resistance test.

Comparative Example K

In Comparative Example K, Comparative Example J was repeated except that the coating used in Example K was chrome-plating. The chrome-plated needle of Example K was cut through after only about 8.9 minutes into the abrasion-resistance test.

Comparative Example L

In Comparative Example L, Comparative Example K was repeated except that Example L used a chrome-fired coating. The chrome-fired coated needle of Example L was cut through after only about 15 minutes into the abrasion-resistance test.

Comparative Example M

In Comparative Example M, Comparative Example L was repeated except that Example M used a chrome-densified coating. The chrome-densified coated needle of Example M was cut through after only about 8 minutes into the abrasion-resistance test.

Comparative Example N

In Comparative Example N, Comparative Example M was repeated except that the coating used in Example N was a tin HVAC material. The tin HVAC-coated needle of Example N was cut through by the CRF yarn after only about 9 minutes into the abrasion-resistance test.

Comparative Example O

In Comparative Example O, Comparative Example A was repeated except that the knitting needle used in Example O was a 7-gauge steel needle. The uncoated, 7-gauge steel knitting needle of Example O was cut through after only about 13 minutes into the abrasion-resistance test.

Comparative Example P

In Comparative Example P, Comparative Example O was repeated except that the knitting needle used in Example P was coated with plasma-applied aluminum oxide. The coated knitting needle of Example P was cut through after only about 16 minutes into the abrasion-resistance test.

Comparative Example Q

In Comparative Example Q, Comparative Example P was repeated except that the Example Q used an aluminum oxide coating formed using an ion beam. The coated knitting needle of Example Q was cut through after only about 16 minutes into the abrasion-resistance test.

Comparative Example R

In Comparative Example R, Comparative Example Q was repeated except that the knitting needle used in Example R was coated with an aluminum oxide material formed by using a cathodic arc. The coated knitting needle of Example R was cut through after only about 18 minutes into the abrasion-resistance test.

Comparative Example S

In Comparative Example S, Comparative Example R was repeated except that Example S used an ICE bar as the machine part. The ICE bar was made of freeze-hardened steel. The ICE bar of Example S was cut through after only about 4 minutes into the abrasion-resistance test.

What is claimed is:

1. A knitting machine part which is resistant to abrasion caused by knitting a yarn comprising a cut-resistant fiber, said knitting machine part comprising:

(A) a base substrate having a surface and having at least one yarn-contacting region for contacting said yarn during the knitting process; and (B) a coating disposed on the surface of at least said yarn-contacting region of said base substrate, wherein said coating comprises titanium carbonitride having a carbon-to-nitrogen weight ratio of from about 1:4 to about 4:1, further wherein said coating has a hardness sufficient to resist abrasion caused by knitting said yarn and said base substrate has a Rockwell-C Hardness value of from about 50 to about 55.

2. A knitting machine part according to claim 1, wherein the carbon-to-nitrogen weight ratio is from about 1:1.5 to about 1.5:1.

3. A knitting machine part according to claim 1, wherein the carbon-to-nitrogen weight ratio is about 1:1.

4. A knitting machine part according to claim 1, wherein said titanium carbonitride coating has been formed on the yarn-contacting region by a chemical vapor deposition process using a deposition temperature of from about 800° C. to about 1000° C.

5. A knitting machine part according to claim 1, wherein said coating has a thickness of at least about 2 microns.

6. A knitting machine part according to claim 1, wherein said base substrate is uniformly coated with said coating.

7. A knitting machine part according to claim 1, wherein said base substrate comprises an iron series metal or a hard sintered alloy.

8. A knitting machine part according to claim 1, wherein said coated base substrate comprises carbon steel or stainless steel, further wherein said coated base substrate has been subjected to a steel-annealing heat treatment process.

9. A knitting machine part according to claim 8, wherein said substrate comprises carbon steel having a carbon content of about 0.86% to about 0.95% by weight and a Rockwell-C Hardness of from about 50 to about 55.

10. A knitting machine part according to claim 1, wherein said knitting machine part is a knitting needle.

11. A knitting machine part according to claim 1, wherein said knitting machine part is a sinker.

12. A method of knitting a yarn comprising a cut-resistant fiber, comprising:

(1) providing said cut-resistant yarn;

(2) providing a knitting machine which includes a knitting machine part comprising:

(i) a base substrate having a surface and having at least one yarn-contacting region for contacting said yarn during a knitting process; and (ii) a coating disposed on the surface of at least said yarn-contacting region of said base substrate, wherein said coating comprises titanium carbonitride, said titanium carbonitride coating formed on said yarn contacting region of said knitting machine part by a chemical vapor deposition process using a deposition temperature of from about 800° C. to about 1000° C., said titanium carbonitride having a carbon-to-nitrogen weight ratio of from about 1:4 to about 4:1, further wherein the coating has a hardness sufficient to resist abrasion caused by knitting said yarn; and (3) subjecting said yarn to a knitting process using said knitting machine such that at least said coated yarn-contacting region of said knitting machine part contacts the yarn.

13. A method according to claim 12, wherein said knitting machine part is a knitting needle.

14. A method according to claim 12, wherein said knitting machine part is a sinker.

15. A method according to claim 12, wherein the titanium carbonitride has a carbon-to-nitrogen weight ratio of from about 1:1.5 to about 1.5:1.

16. A method according to claim 12, wherein the titanium carbonitride has a carbon-to-nitrogen weight ratio of about 1:1.

17. A method according to claim 12, wherein said base substrate has a Rockwell-C Hardness value of from about 50 to about 55.

18. A method according to claim 12, wherein said surface of said base substrate of said knitting machine part is uniformly coated with said coating.

19. A method according to claim 12, wherein said coating has a thickness of at least about 2 microns.

20. A method according to claim 12, wherein said base substrate of said knitting machine part comprises an iron series metal or a hard sintered alloy.

21. A method according to claim 12, wherein said coated base substrate comprises carbon steel or stainless steel as the substrate, further wherein said coated base substrate has been subjected to a steel-annealing heat treatment process.

22. A method according to claim 21, wherein said steel-annealing heat treatment process comprises the steps of:

(i) heating said coated substrate to a temperature sufficient to austentize said substrate;

(ii) quenching said austentized coated substrate at a rate such that upon tempering and cooling of the austentized coated substrate, the tempered-cooled substrate has a hardness sufficient to withstand the forces associated with knitting;

(iii) heating said quenched coated substrate to a temperature sufficient to temper said substrate; and (iv) cooling the tempered coated substrate, whereby the cooled substrate has a hardness sufficient to withstand the forces associated with knitting.

23. A method according to claim 22, wherein in the steel-annealing process, the coated substrate is heated to a temperature of at least about 750° C. in step (i) to austentize the coated substrate; the austentized substrate is subsequently quenched in an inert atmosphere in a 20-bar furnace or in oil with agitation at a temperature of about 60° C. to about 200° C. in step (ii); and the quenched substrate is heated to a temperature of from about 250° C. to about 350° C. in step (iii) to temper the quenched coated substrate.

24. A method according to claim 22, wherein said substrate comprises a carbon steel having a carbon content of about 0.86% to about 0.95% by weight and a Rockwell-C Hardness of from about 50 to about 55.

25. A method of knitting a yarn, comprising:

(1) providing said yarn;

(2) providing a knitting machine which includes a knitting machine part comprising:

(i) a base substrate having a surface and having at least one yarn-contacting region for contacting said yarn during a knitting process; and (ii) a coating disposed on the surface of at least said yarn-contacting region of said base substrate, wherein said coating comprises titanium carbonitride having a carbon-to-nitrogen weight ratio of from about 1:4 to about 4:1, further wherein said coating has a hardness sufficient to resist abrasion caused by knitting a yarn comprising a cut-resistant fiber; and (3) subjecting said yarn to a knitting process using said knitting machine such that at least said coated yarn-contacting region of said knitting machine part contacts said yarn.

26. The method as recited in claim 25, wherein said yarn comprises abrasive fibers.

27. The method as noted in claim 25, wherein said yarn comprises cut-resistant fibers that comprise hard particles.

28. The method as recited in claim 25, wherein said yarn comprises conventional fibers.

29. A machine part that contacts yarn in a machine that handles, processes or manufactures yarns, said machine part comprising:

(i) a base substrate having a Rockwell-C Hardness value of from about 50 to about 55, said base substrate further having a surface and at least one yarn-contacting region;

(ii) a coating disposed on the surface of said base substrate on at least the yarn-contacting region of said base substrate, wherein said coating comprises titanium carbonitride having a carbon-to-nitrogen ratio of from about 1:4 to about 4:1.

30. A machine part according to claim 29, wherein the carbon-to-nitrogen weight ratio is from about 1:1.5 to about 1.5:1.

31. A machine part according to claim 29, wherein the carbon-to-nitrogen weight ratio is about 1:1.

32. A machine part according to claim 29, wherein said titanium carbonitride coating has been formed on the yarn-contacting region by a chemical vapor deposition process using a deposition temperature of from about 800° C. to about 1000° C.

33. A machine part according to claim 1, wherein said base substrate comprises an iron series metal or a hard sintered alloy.

34. A machine part as recited in claim 29, wherein said machine is a knitting machine and said machine part is selected from the group consisting of needles, sinkers, sinker plates, guides, and cutters.

35. A machine part as recited in claim 29, wherein said machine is a weaving loom and said machine part is selected from the group consisting of guides, pins, tension disks, tension poles, drop wires, drop wire holding rods, scissors, heddles, reeds, fill insertion equipment, shuttle parts, and rapier head parts.

36. A machine part as recited in claim 29, wherein said machine is a yarn twisting, repackaging, or wrapping machine and said machine part is selected from the group consisting of guides, tensioning equipment, and rings.

37. A machine part as recited in claim 29, wherein said machine is used for beaming and said machine part is selected from the group consisting of guides and tension bars.

38. A machine having greater resistance to abrasion that results from handling, processing, or manufacturing abrasive yarns, said machine comprising the part recited in claim 29.

39. The machine recited in claim 38, wherein said machine is selected from the group consisting of knitting machines, weaving looms, yarn twisting machines, yarn repackaging machines, yarn wrapping machines, and beaming equipment.

40. A knitting machine part produced according to the process of:

(A) providing a base substrate comprising stainless steel or carbon steel having a carbon content of about 0.86% to about 0.95% by weight, said base substrate having a surface with at least one yarn-contacting region for contacting yarn during a knitting process;

(B) coating said at least said yarn-contacting region of said base substrate, wherein said coating comprises titanium carbonitride having a carbon-to-nitrogen weight ratio of from about 1:4 to about 4:1 and said coating has a hardness sufficient to resist abrasion caused by knitting said yarn; and (C) subjecting said coated base substrate to a steel-annealing heat treatment process comprising:

(i) heating said coated substrate to a temperature of at least about 750° C. to austentize said substrate;

(ii) quenching said austentized coated substrate in an inert atmosphere in a 20-bar furnace or in oil with agitation at a tempaerature of about 60° C. to about 200° C., said quenching performed at a rate such that upon tempering and cooling of the austentized coated substrate, said tempered-cooled substrate has a hardness sufficient to withstand the forces associated with knitting;

(iii) heating said quenched coated substrate to a temperature of from about 250° C. to about 350° C. to temper said substrate; and (iv) cooling the tempered coated substrate, whereby the cooled substrate has a Rockwell-C Hardness of from about 50 to about 55.

41. A method for coating metal parts comprising:

(a) providing a metal substrate comprised of a metal selected from the group consisting of carbon steel and stainless steel;

(b) coating at least one surface of said substrate with a composition comprising titanium carbonitride wherein said coating is formed on said surface by a chemical vapor deposition process using a deposition temperature of from about 800° C. to about 1000° C., said composition having a carbon-to-nitrogen weight ratio of from about 1:4 to about 4:1; and (c) subjecting said coated substrate to a steel-annealing heat treatment process.

* * * * *